United States Patent [19]

Seanor

[11] Patent Number: 4,457,615

[45] Date of Patent: Jul. 3, 1984

[54] COMBINED CHARGE/CLEANING BRUSH FOR USE IN A XEROGRAPHIC COPIER

[75] Inventor: Donald A. Seanor, Pittsford, N.Y.

[73] Assignee: Xerox Corporation, Stamford, Conn.

[21] Appl. No.: 437,996

[22] Filed: Nov. 1, 1982

[51] Int. Cl.[3] ..... G03G 15/00

[52] U.S. Cl. ..... 355/3 CH; 355/14 CH; 355/15; 15/1.5 R; 118/652; 430/125

[58] Field of Search ..... 355/15, 30 D, 14 D, 355/3 CH, 14 CH; 430/122, 125; 118/652; 15/256.51, 256.52, 1.5 R

[56] References Cited

U.S. PATENT DOCUMENTS

| | | | |
|---|---|---|---|
| 2,774,921 | 12/1956 | Walkup | 317/263 |
| 3,780,391 | 12/1973 | Leenhouts | 15/1.5 |
| 3,781,107 | 12/1973 | Ruhland | 355/15 |
| 3,847,480 | 11/1974 | Fisher | 355/15 |
| 4,110,035 | 8/1978 | Kamata | 355/15 |
| 4,123,154 | 10/1978 | Fisher | 355/15 |
| 4,174,903 | 11/1979 | Snelling | 355/3 CH |
| 4,336,565 | 6/1982 | Murray et al. | 361/225 |
| 4,361,922 | 12/1982 | Karal | 355/15 X |
| 4,395,114 | 7/1983 | Ura et al. | 355/15 |

FOREIGN PATENT DOCUMENTS 976027 5/1963 United Kingdom .

*Primary Examiner*—A. C. Prescott

[57] ABSTRACT

An electrically conductive brush is provided for effecting simultaneous charging and cleaning of a photoreceptor surface. The brush is constructed of alternate conductive and non-conductive segments which causes one conductive segment which is being used for charging to be electrically isolated from another conductive segment which is being used for cleaning. Thus, different voltages can be simultaneously applied to each of the segments without adversely affecting the operation of the other. A single detoning roller is also provided for removing toner particles from the brush, the detoning roller being positioned adjacent the cleaning segment to allow for the application thereto of a lower voltage than would be required if the detoning roller was used in conjunction with a charging brush of the prior art or with the charging segment of the brush of this invention.

12 Claims, 3 Drawing Figures

COMBINED CHARGE/CLEANING BRUSH FOR USE IN A XEROGRAPHIC COPIER

This invention relates, in general, to xerographic copiers and, more particularly, to a conductive brush for uniformly charging and removing residual toner from a photoreceptor.

The use of a conductive brush to which a suitable potential is applied for placing a uniform electrostatic charge on a photoconductive surface has been proposed in U.S. Pat. Nos. 2,774,921; 4,174,903 and 4,336,565 and U.K. Pat. No. 976,027. All but U.S. Pat. No. 4,174,903 use a fiber or fiber-like brush while U.S. Pat. No. 4,174,903 uses a magnetic brush structure. Also, the charging device of U.S. Pat. No. 4,174,903 patent is used for cleaning the photoreceptor as well as charging it.

In the xerographic process, the photoreceptor, prior to moving through the charging station, moves through a cleaning station where residual toner is moved therefrom in order to prepare the photoreceptor for the next copying cycle. Even though the residual toner is removed, and other precautions are taken to preclude contamination of machine components, such as the charging unit, with toner particles, toner in one way or another finds its way into the fibers of the conductive brush thereby adversely affecting its operation.

One effective method of removing toner from an electrically conductive brush, as disclosed in copending U.S. Pat. application Ser. No. 130,805, filed in the name of Seaner et al and No. D/80371 filed in the name of Seanor is contacting the fibers of the brush with an insulative detoning roller to which an electrical bias is applied of the same polarity as that applied to the conductive brush but at twice the voltage. As can be appreciated since the bias on the aforementioned cleaning brush is low, the bias on the detoning roller is correspondingly low.

The conductive charging device contemplated by this invention in contrast to the voltage required for cleaning, requires a substantially higher applied potential. Thus, voltages on the order of 1200 volts are required to accomplish suitable photoreceptor charging. Therefore, in order to employ an electrically biased detoning roll as disclosed in the aforementioned copending applications the required voltage to be applied to the detoning roll would be on the order of 2400 volts.

As a general preposition, it is better to use the lowest operating potentials possible to thereby minimize costs and safety hazards and also to conserve energy. Also, if fewer parts are employed, the copier will be less costly and complex.

In the interest of reducing costs and the complexity of xerographic copiers, more and more components of the machine are being designed for multiple functions. For example, as disclosed in U.S. Pat. No. 4,174,903, the charging and cleaning functions are effected by a single component. As a matter of fact, that same component is also used for two (i.e. devlopment and transfer) other functions.

In accordance with the present invention, I have provided a single component for performing both the charging and cleaning functions. However, unlike the device of U.S. Pat. No. 4,174,903 patent, I have provided for removing toner from my charging brush in order to extend its useful life. Not only has cleaning of a charging brush been provided but such cleaning is effected with an electrically biased roller at a very low potential level. Moreover, a single detoning roller is used for removing toner accumulated on the combination charging and cleaning brush.

To accomplish the foregoing, there is provided a conductive fiber brush wherein segments or areas of the brush containing conductive fibers are separated by non-conductive sections of fibers. A cleaning brush construction comprising alternate conductive and non-conductive segments is disclosed in U.S. Pat. No. 3,780,391 issued in the name of Leenhouts. In this manner, the conductive segments or areas are electrically isolated one from the other. Accordingly, different potentials can be applied simultaneously to at least two different segments without adversely effecting each other. With proper design of this type of brush structure, I have made it possible to contact the photoreceptor in two adjacent process stations simultaneously to effect the two functions at the same time. Thus, different conductive segments of the brush can contact the photoreceptor in one area thereof for the purpose of charging and in the other thereof for the purpose of cleaning. Because these segments are electrically isolated, different voltages can be applied thereto. For example 1200 volts can be applied for charging while simultaneously 200 volts can be applied for cleaning. Furthermore, since there is only one brush, only one detoning roller is required and by positioning it adjacent to the segment of the brush which is performing the cleaning, the voltage applied to the detoning roll need only be the twice the cleaning voltage rather than twice the considerably higher charging voltage.

Other aspects of the present invention will become apparent as the following description proceeds and upon reference to the drawings, in which.

For a general understanding of the features of the present invention, a description thereof will be made with references to the drawings.

Figure 1:
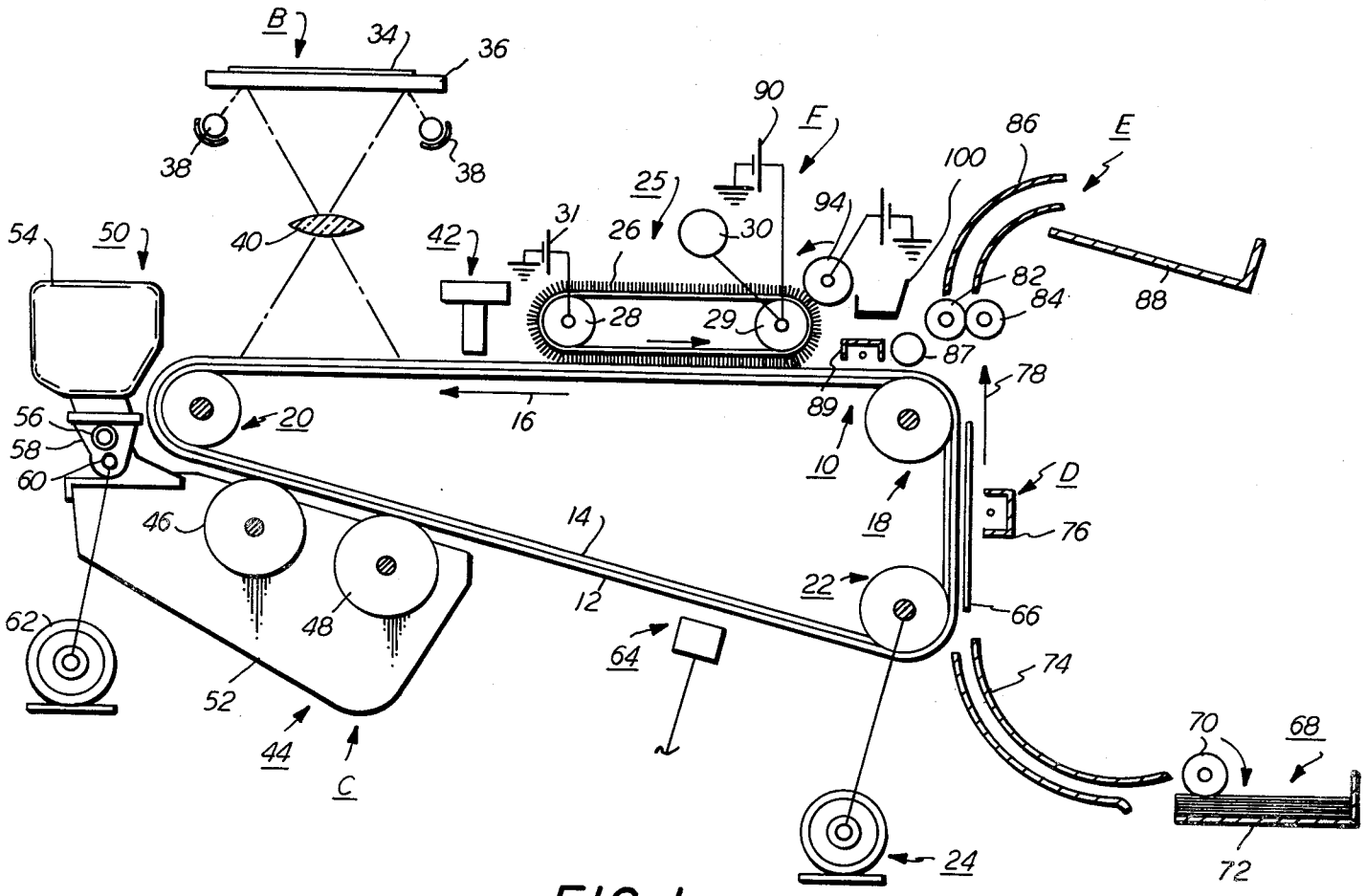
FIG. 1 is a schematic elevational view of an electrophotographic printing machine incorporating the features of the present invention therein.

FIG. 1 schematically depicts the various components of an illustrative electrophotographic printing machine incorporating the present invention. In as much as the art of electrophotographic printing is well known, the various processing stations employed in the printing machine illustrated in FIG. 1 will be described briefly.

As shown in FIG. 1, the printing machine utilizes a photoconductive belt 10 which consists of a photoconductive surface 12 and an electrically conductive substrate 14. Belt 10 moves in the direction of arrow 16 to advance successive portions thereof sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive.

Belt 10 is maintained in tension by a pair of springs (not shown) resiliently urging tension roller 20 against belt 10 with the desired spring force. Both stripping roller 18 and tension roller 20 are rotatably mounted.

These rollers are idlers which rotate freely as belt 10 moves in the direction of arrow 16.

Figure 2:
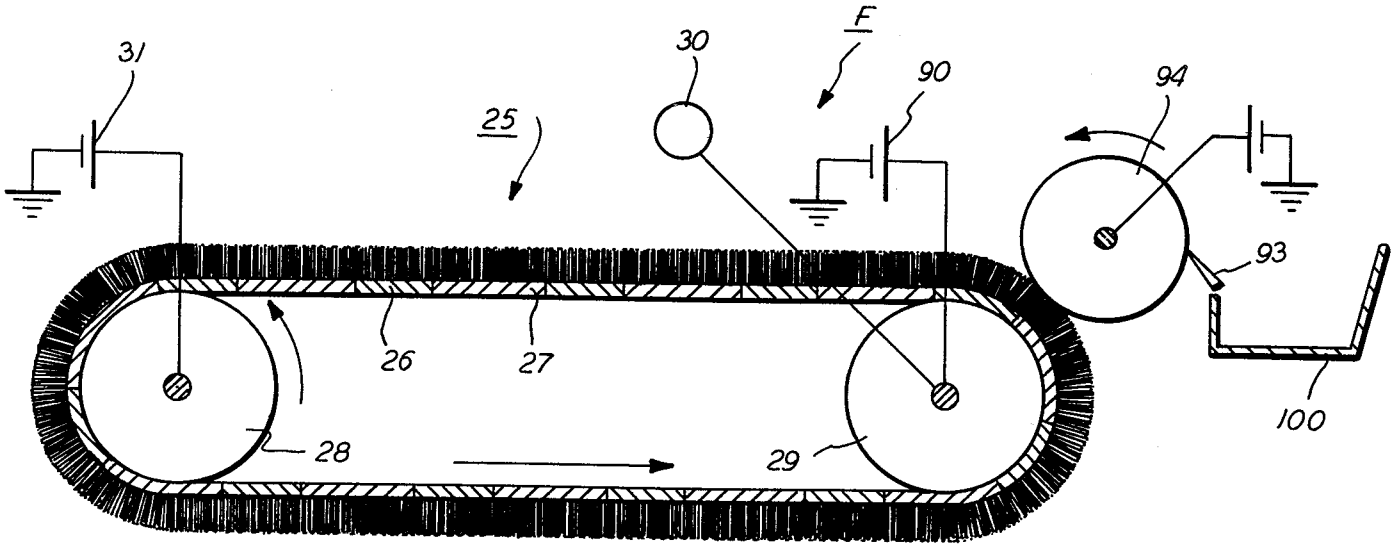
FIG. 2 is a schematic illustration of a combined charging and cleaning brush utilized in the machine illustrated in FIG. 1.

As can be seen by reference to FIGS. 1 and 2, initially a portion of belt 10 passes through charging station A. At charging station A, a brush structure, indicated generally by the reference numeral 25, charges the belt 10 to a selectively high uniform potential. The brush structure (see FIG. 2) comprises alternate conductive and non-conductive segments or areas 26 and 27, respectively. While the brush structure is illustrated as being in the form of a belt it will be appreciated by those skilled in the art that it may also be in the form of a roller or any other suitable shape. The brush is entrained about a pair of conductive rollers 28 and 29 the latter of which is operatively coupled to a motor 30 for imparting revolving motion to the brush to bring successive segments thereof into contact with the photoreceptor 10. A suitable source of potential 31 is provided for applying approximately 1200 volts to the conductive roller 28 so that the photoreceptor can be uniformly charged through contact with the conductive segments which contact the photoreceptor at the charging station.

Next, the charged portion of photoconductive surface is advanced through exposure station B. At exposure station B, an original document 34 is positioned facedown upon a transparent platen 36. Lamps 38 flash light rays onto original document 34. The light rays reflected from original document 34 are transmitted through lens 40 forming a light image thereof. Lens 40 focuses the light image onto the charged portion of photoconductive surface 12 to selectively dissipate the charge thereon. This records an electrostatic latent image on photoconductive surface 12 which corresponds to the informational areas contained within original document 34.

Exposure station B may include a test area generator 42. Test generator 42 comprises a light source electronically programmed to two different output levels. In this way, two different intensity test light images are projected onto the charged portion of photoconductive surface 12 in the inter-image area to record two test areas thereon. The light output level from test area generator 42 is such that one of the test light images receives an exposure of about 2.5 ergs/centimeter$^2$ with the other test light image receiving an exposure of about 1.7 ergs/centimeter$^2$. These test light images are projected onto the charged portion of photoconductive surface 12 to form the test areas. Both of these two test areas are subsequently developed with toner particles. Test area generator 42 is continuously programmable from 0.0 to 6.0 ergs/centimeter$^2$. The exposure accuracy is $\pm 3\%$ over a range of from about 0.5 to about 3.5 ergs/centimeter$^2$. Each test area recorded on photoconductive surface 12 is rectangular and about 10 millimeters by 18 millimeters in size. Thus, the test area generator will expose the inter-image area to a level between 0.5 to 3.5 ergs/centimeter$^2$. Preferably, one test area will be exposed at a light intensity of about 2.5 ergs/centimeter$^2$ with the other test area being exposed at an intensity of about 1.7 ergs/centimeter$^2$. After the electrostatic latent image has been recorded in photoconductive layer 12 and the test areas recorded in the inter-image areas, belt 10 advances the electrostatic latent image and the test areas to development station C.

At development station C, a magnetic brush development system, indicated generally by the reference numeral 44 advances a developer material into contact with the electrostatic latent image and the test areas. Preferably, magnetic brush development system 44 includes two magnetic brush developer rollers 46 and 48. These rollers each advance the developer material into contact with the latent image and test areas. Each developer roller forms a brush comprising carrier granules and toner particles. The latent image and test areas attract the toner particles from the carrier granules forming a toner powder image on the latent image and a pair of developed mass areas corresponding to each of the test areas. As successive electrostatic latent images are developed, toner particles are depleted from the developer material. A toner particle dispenser, indicated generally by the reference numeral 50, is arranged to furnish additional toner particles to housing 52 for subsequent use by developer rollers 46 and 48 respectively. Toner dispenser 50 includes a container 54 storing a supply of toner particles therein. A foam roller 56 disposed in a sump 58 coupled to container 54 dispenses toner particles into an auger 60. Auger 60 comprises a helical spring mounted in a tube having a plurality of apertures therein. Motor 62 rotates the helical member of auger to advance the toner particles through the tube 30 that toner particles are disposed from the apertures thereof. Nominally, the test area which has been exposed at 2.5 ergs/centimeter$^2$ will have a toner particle developed mass/area of approximately 0.1 milligrams/centimeters$^2$. The test area which has been exposed at 1.7 ergs/centimeter$^2$ will have a toner particle developed mass/area of approximately 0.4 milligrams/centimeter$^2$. The developed test areas pass beneath a collimated infrared densitometer, indicated generally by the reference numeral 64.

Infrared densitometer 64, positioned adjacent photoconductive surface 12 between developer station C and transfer station D, generates electrical signals proportional to the developed toner mass of the test areas. These signals are conveyed to a controller (not shown) for suitable processing thereat. The controller can be used to regulate power supply 31 and motor 62 so as to control charging of photoconductive surface and dispensing of toner particles into the developer mixture. Infrared densitometer 64 is energized at 15 volts d.c. and about 50 milliamps. The surface of infrared densitomer 64 is preferably about 7 millimeters from photoconductive surface. Infrared diode having a 940 nanometer peak output wavelength with a 60 nanometer one-half power bandwidth. The power output is approximately $45 \pm 10$ milliwatts. A photodiode receives the light rays reflected from the test areas on photoconductive surface 12 of belt 10. The photodiode converts the measured light ray input to an electrical output signal ranging from about 0 volts to about 10 volts. Infrared densitometer 64 is also used periodically to measure the light rays reflected from the bare photoconductive surface, i.e. without developed toner particles, to provide a reference level for calculation of the signal ratios. An air purge system is associated with the infrared densitometer to prevent the accumulation of particles on the optics thereof. After the developed electrostatic latent image and developed test areas have passed beneath infrared densitometer 64, belt 10 advances the toner powderimage to transfer station D.

A sheet of support material 66 is moved into contact with the toner image at transfer station D. The sheet of support material is advanced to transfer station D by sheet feeding apparatus 68. Preferably, sheet feeding apparatus 68 includes a feed roll 70 contacting the uppermost sheet of stack 72. Feed rolls 70 rotate so as to advance the uppermost sheet from stack 72 into chute 74. Chute 74 directs the advancing sheet of support material into contact with photoconductive surface 12 of belt 10 in a timed sequence so that the toner powder image developed thereon contacts the advancing sheet of support material at transfer station D.

Transfer station D includes a corona generating device 76 which sprays ions of a suitable polarity onto the backside of sheet 66. This attracts the charged toner powder image from photoconductive surface 12 to sheet 66. After transfer, the sheet continues to move, in the direction of arrow 78, onto a conveyor (not shown) which advances the sheet to fusing station E.

Fusing station E includes a fuser assembly, indicated generally by the reference numeral 80, which permanently affixes the transferred powder image to sheet 66. Preferably, fuser assembly 80 comprises a heated fuser roller 82 and a back-up roller 84. Sheet 66 passes between fuser roller 82 and back-up roller 84 with the toner powder image contacting fuser roller 82. In this manner, the toner powder image is permanently affixed to sheet 66. After fusing, chute 86 guides the advancing sheet 66 to catch tray 88 for subsequent removal from the printing machine by the operator.

After the sheet of support material is separated from photoconductive surface of belt 10, the residual toner particles and the toner particles of the developed test areas adhering to photoconductive surface are removed therefrom. These particles are removed from photoconductive surface at cleaning station F. Prior to the toner to be removed at the cleaning station F, it moves past an exposure lamp 87 and a preclean corotron 89.

Subsequent to cleaning, discharge lamp (not shown) floods the photoconductive surface with light to dissipate any residual electrostatic charge remaining prior to the charging thereof for the successive imaging cycle.

At the cleaning station F, the fibers of the brush structure 25 contact the photoreceptor to thereby remove residual toner therefrom. At their points of contact with the photoreceptor at the cleaning station the fibers have approximately 200 volts applied thereto via the conductive roller 29, such voltage being supplied by a suitable power source 90. To remove the toner picked up by the brush structure at the cleaning station as well as any other toner that may be picked by the brush as, for example, during the charging function there is provided an insulative detoning roll 94 is supported for rotation in contact with the conductive brush 25 and at twice the speed of the brush. A source of voltage 96 electrically biases the roll 94 to the same polarity as the brush 90 is biased. However, the magnitude of this bias is greater than the bias applied to the brush. For example, a suitable bias would be 400 volts when the bias on the conductive roll 29 is 200 volts. Preferably, the roll 92 is fabricated from anodized aluminum whereby the surface of the roll contains an oxide layer of about 20 to 30 microns and is capable of leaking charge to preclude excessive charge buildup on the detoning roll. The roll 92 is supported for rotation by a motor 93.

A metering blade 98 contacts the roll 94 for removing the toner therefrom and causing it to fall into a collector 100.

Figure 3:
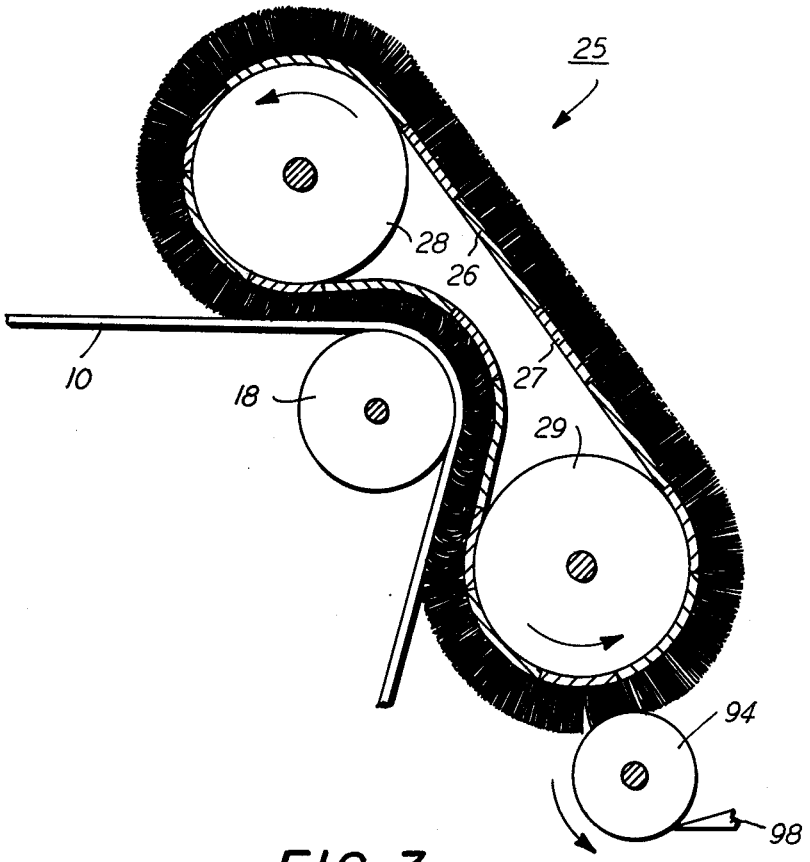
FIG. 3 is a modified form of the combined brush of FIG. 2.

An alternate method of positioning the brush structure 25 relative to the photoreceptor is illustrated in FIG. 3.

It can now be appreciated that there has been provided a brush structure which can be utilized for simultaneously charging and cleaning a photoreceptor. To this end, the brush structure comprises alternate conductive and non-conductive segments or areas the conductive segments electrically isolated from each other by non-conductive segments. Thus, different voltages can be applied to different conductive segments without adversely affecting each other. In this manner, charging and cleaning can be carried out simultaneously. Additionally, the brush structure is cleaned of toner using a single detoning roller which is in wiping contact with the brush structure adjacent the cleaning station rather than the charging station which permits low voltage biasing of the detoning roller.

I claim:

1. Xerographic copier apparatus comprising:

a photoconductive surface;

a brush supported for wiping contact with said surface and adapted to have different electrical biases applied simultaneously thereto;

means for electrically biasing said brush to at least a first voltage level for uniformly charging said surface to a voltage level sufficient for forming electrostatic images thereon;

means for exposing the uniformly charged surface to a light image to form a latent electrostatic image on said surface;

means for developing said latent electrostatic image with toner; and means for simultaneously electrically biasing said brush to a second voltage level different from said first voltage level, said second voltage level being sufficient to attract residual toner particles from said photoconductive surface.

2. Apparatus according to claim 1, including means contacting said brush for removing toner therefrom.

3. Apparatus according to claim 1 wherein said brush comprise alternate conductive and non-conductive areas comprising substantially equal length fibers which contact said surface, said non-conductive areas serving to electrically isolate the conductive areas such that the biasing of said brush to said at least one voltage and to said second voltage can be effected simultaneously.

4. Apparatus according to claim 3 wherein said brush is constructed such that at least two conductive areas simultaneously contact said photoconductive surface and wherein said first voltage level is applied to one of said at least two conductive areas and said second voltage level is applied to the other of said at least conductive areas.

5. Apparatus according to claim 2 wherein said toner removal means contacts said other of said at least two areas and is electrically biased so as to remove toner from said brush.

6. Apparatus according to claim 5 wherein said first voltage level is on the order of 1200 volts and said second voltage level is on the order of 200 volts.

7. Apparatus according to claim 6 wherein the bias on said toner removal means is on the order of 400 volts and of the same polarity as said second voltage level.

8. Apparatus according to claim 5 wherein said toner removal means comprise a roll structure.

9. Apparatus according to claim 8 wherein the surface of said roll structure is anodized aluminum.

10. Apparatus according to claim 9 wherein said brush comprises a belt structure.

11. Apparatus according to claim 4 wherein said brush comprises a plurality of fibers.

12. Apparatus according to claim 3 wherein said brush comprises a belt structure.

* * * * *